US006000698A

United States Patent [19]

Woodward

[11] Patent Number: 6,000,698

[45] Date of Patent: Dec. 14, 1999

[54] CHESS PIECE

[76] Inventor: Warren Woodward, P.O. Box 438, Willoughby, N.S.W., Australia, 2068

[21] Appl. No.: 08/112,576

[22] Filed: Aug. 25, 1993

[30] Foreign Application Priority Data

Aug. 28, 1992 [AU] Australia ..... PL4367

[51] Int. Cl.[6] ..... A63F 3/02

[52] U.S. Cl. ..... 273/260; 273/288

[58] Field of Search ..... 273/260, 261, 273/288, 290

[56] References Cited

U.S. PATENT DOCUMENTS

| | | | |
|---|---|---|---|
| D. 169,230 | 3/1953 | Wade | 273/288 X |
| 3,627,324 | 12/1971 | Krepp . | |
| 3,947,040 | 3/1976 | Samuels . | |
| 4,226,419 | 10/1980 | Wooden | 273/260 |
| 4,699,385 | 10/1987 | Bifulco | 273/260 |

OTHER PUBLICATIONS

1991 Catalog of Supercast Ltd. showing a beginner's chess set.

Waddington's Illustrated Encyclopedia of Games, Pan Books, London, 1984, pp. 50–51.

Oxford Companion to Chess, D. Hooper K. Whild, Oxford University Press, Oxford 1984, p. 308.

*Primary Examiner*—William H. Grieb

*Attorney, Agent, or Firm*—David P. Gordon; David S. Jacobson; Thomas A. Gallagher

[57] ABSTRACT

A set of pieces facilitates the playing of a modified form of chess in which the captor of a piece can return that piece to the board as the captor's own. The set comprises two subsets of pieces, each piece having an upright stem having a shape which denotes the piece's denomination and a direction indicator which denotes the ownership of the piece.

4 Claims, 3 Drawing Sheets

CHESS PIECE

BACKGROUND OF THE INVENTION

The present invention relates to a set of pieces for playing a modified form of chess. In particular, the set facilitates the playing of a form of chess in which captured players can be used by the captor.

In conventional, International-style chess, the set consists of two sub-sets, each consisting of 8 pawns, 2 rooks, 2 knights, 2 bishops, a king and a queen. Each subset is 'owned' by a player, with the denomination of each piece—and hence the moves available to that piece—being indicated by the shape of the piece. The ownership of the pieces is denoted by its colour. In a conventional set one subset is coloured white and the other black. According to the rules of chess, a captured piece is removed from the board and takes no further part in the game. The orientation of the chess pieces on the board is immaterial to the conduct of the game.

In U.S. Pat. No. 3,627,324 to Krepp, it was proposed to provide arrowlike designations to the top of chess pieces to indicate the possible moves available to each piece. In the game described in that patent, it was permissible to rotate some pieces as a separate move, thus changing the directions in which those pieces may be moved subsequently. The ownership of the pieces is designated by the colour of the pieces, as in conventional chess.

U.S. Pat. No. 3,947,040 to Samuels describes chess pieces adapted for use by players learning the game, having a plate removably attached to the piece for indicating the name, symbol, numerical value and permissible moves of that piece. The plates are simply learning tools for new players, and otherwise play no role in the game itself.

The traditional Japanese game of Shogi is played with flat tiles which are square at their rear and pointed or curved at their front. All pieces in the Shogi set are the same colour or combination of colours, so that there is no visual distinction between the pieces of the two players. The denomination of the pieces is indicated by their size and by Japanese characters written on the tiles. Markings on the bottom of the pieces of some denominations allow those pieces to be inverted to denote a change in the denomination due to promotion of the piece during the game.

In Shogi, the ownership of the pieces is indicated by the direction in which the piece is facing. When a piece is captured, the captor is able to keep it in hand and later return it to the board and use it as the captor's own, except that any powers that the piece has previously gained by promotion are forfeited by returning the piece to its non-inverted state.

SUMMARY OF THE INVENTION

It is an object to provide a set of pieces suitable for use in a new chess-type game loosely based on an amalgam of some of the rules of conventional chess and of Shogi, or for use in other games. The construction of the set is designed to facilitate playing of the new game by players who are accustomed to playing chess.

The present invention thus provides a set of pieces for a chess-type game between two players, comprising two subsets of pieces for ownership initially by respective of the players, wherein each piece has an upright stem portion having a shape which indicates the denomination of the piece and direction indicating means which indicates a direction denoting the ownership of the piece.

Preferably, the two subsets are substantially visually indistinguishable, the ownership of the pieces in play being solely denoted by the direction indicating means.

In one preferred form, the direction indicating means comprises the shape of a base portion of the piece.

BRIEF DESCRIPTION OF THE DRAWINGS

Further preferred forms of the invention will now be described with reference to the accompanying drawings, in which.

DESCRIPTION OF THE P REFERRED EMBODIMENT

Figure 1:
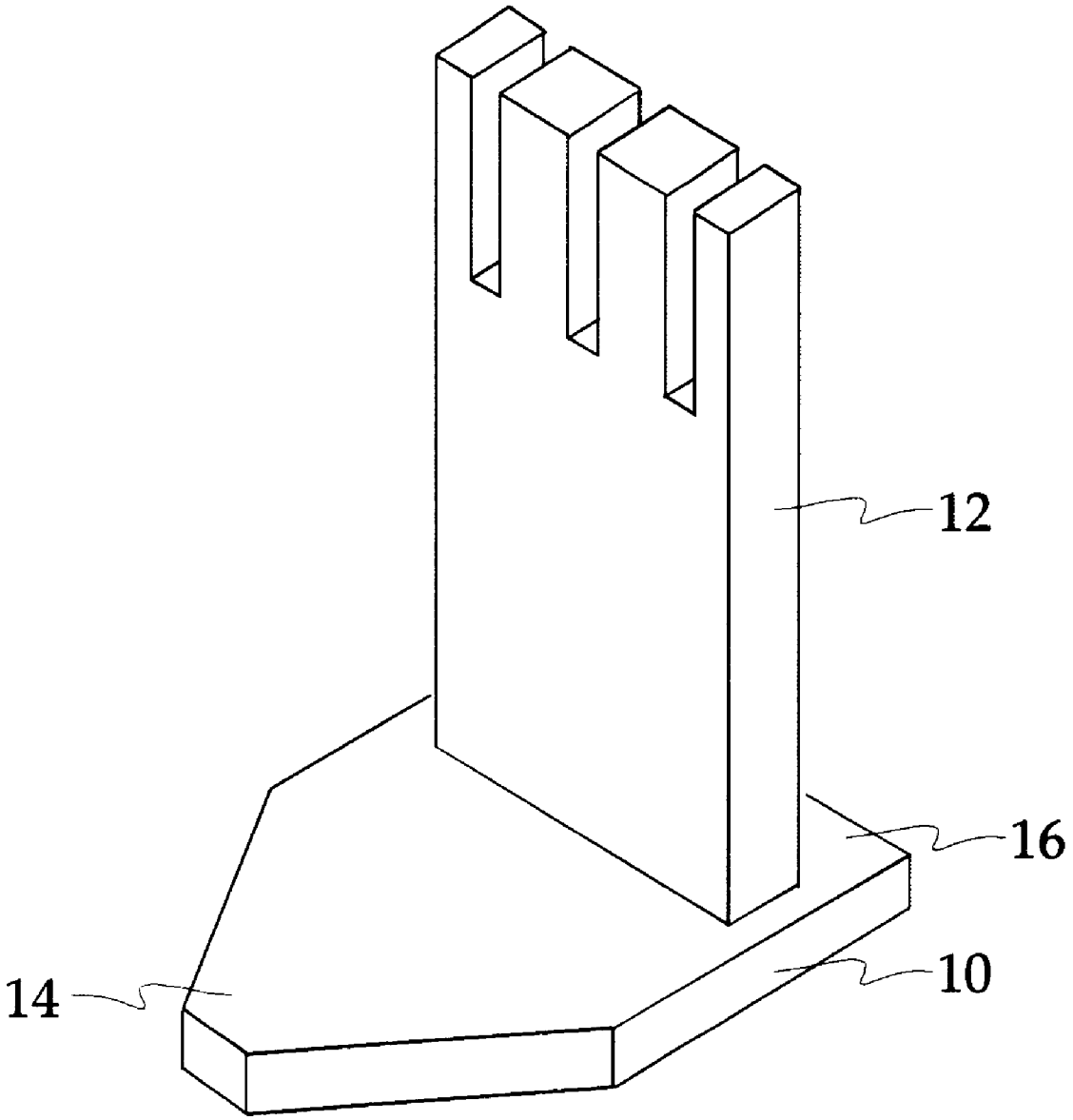
FIG. 1 is a perspective view of a games piece according to the invention.

Referring to FIG. 1, which illustrates a stylised rook piece of a set of pieces according to the invention, the piece consists generally of a flat base portion 10 and an upright stem 12 integrally formed, for example, by carving or plastics moulding.

The front 14 and rear 16 of the base are mutually assymetrical, the front being tapered to point in the direction of play and the rear being square or rounded. In an alternative, unillustrated form, the front of the piece may be rounded and the rear is square.

The upright stem 12 is shaped to symbolise the denomination of the piece, and thus the moves available to the piece. In the piece illustrated in FIG. 1, the top of the stem is castellated to designate the traditional castle shape for the rook.

The full set of pieces comprises two substantially indistinguishable and interchangable subsets. All pieces are the same colour or combination of colours. The stem shapes may be identical to or suggestive of closely analogous pieces for chess, for example the Staunton set, in order to aid learning of the new game by players familiar with chess. The layout of the board and the number and denomination of pieces in each subset may differ from chess, although it is preferred that the pieces retain a hierarchical structure.

Figure 2:
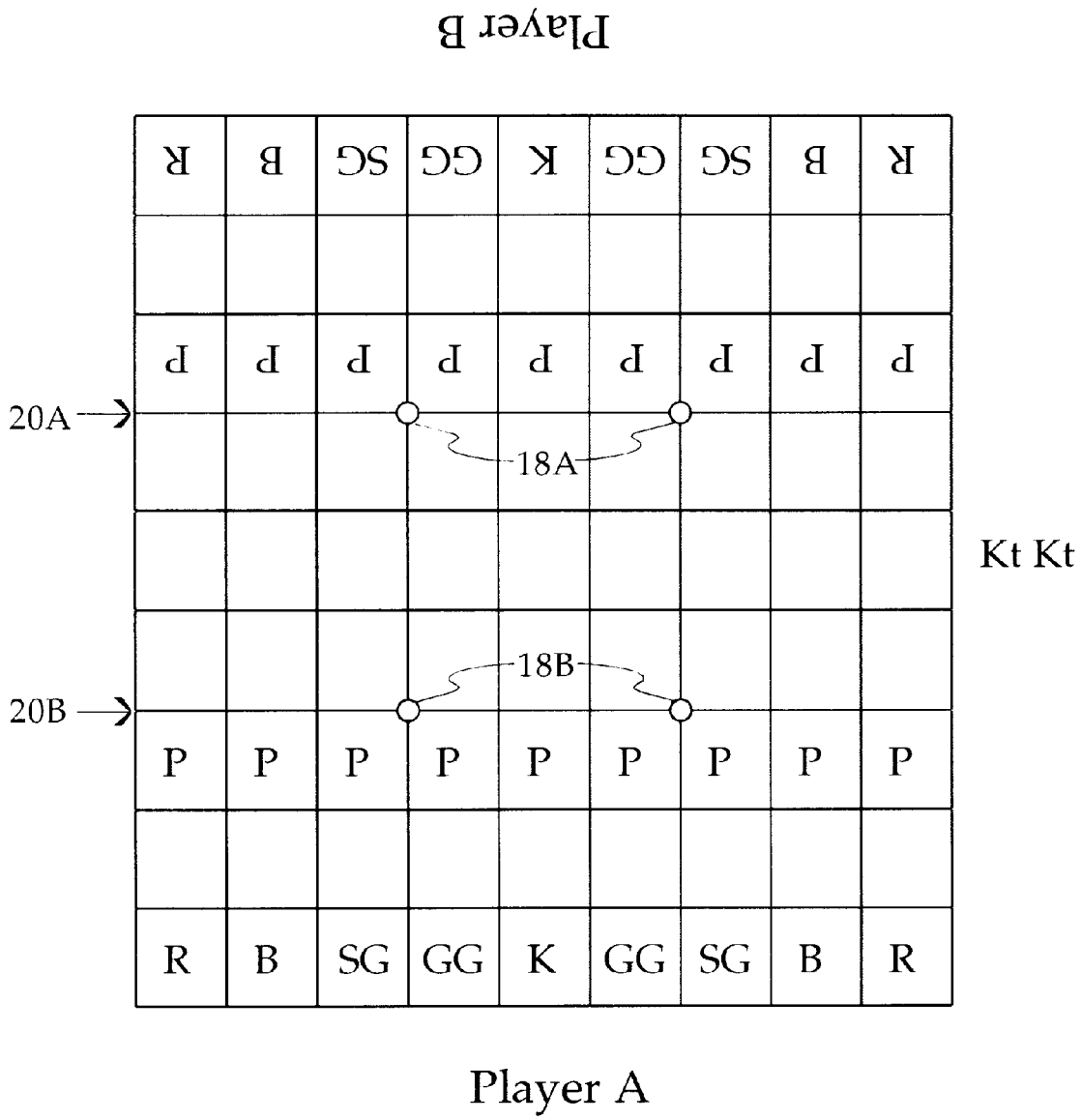
FIG. 2 shows the initial set up of the pieces in a preferred game.
Figure 3:
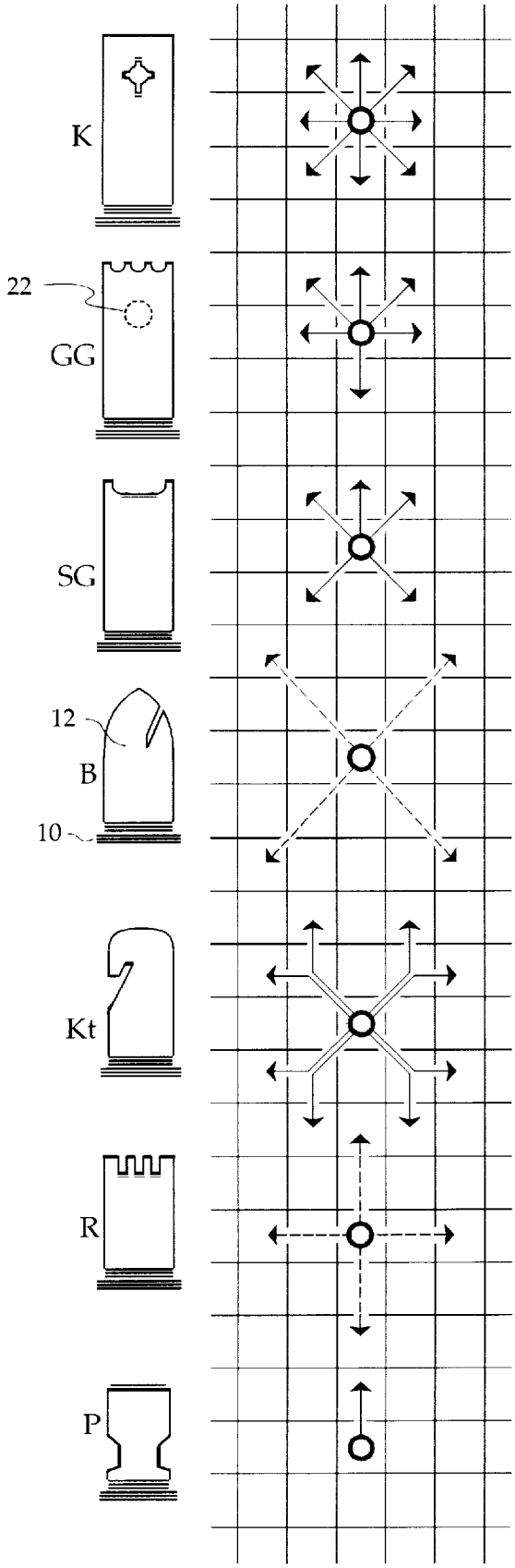
FIG. 3 shows the permissible moves of the pieces in the preferred game.

FIGS. 2 and 3 illustrate a preferred game to be played with a set of pieces according to the invention.

The board has 9×9 slightly rectangular "squares", alternating in black and white, with markings 18A,18B indicating promotion lines 20A and 20B. The set of pieces includes two subsets, each having 18 pieces one king (K), two gold generals (GG), two silver generals (SG), two bishops (B), two rooks (R), and nine pawns (P). In addition, the set contains two knights (Kt), which are not owned by either player at the commencement of the game.

At the commencement of play, each player's pieces are arranged in the first and third ranks closest to the player as shown in FIG. 2. The two knights are off the board for addition to the game at a later stage, as will be described below.

As shown in FIG. 3, the movements of the king, bishop and rook, and of the knight when it joins the game, are the same as those in chess. The movements of the gold and silver generals and the pawns are the same as in Shogi. The gold general can move one square in any direction, except diagonally backward. The silver general may move one square diagonally or one square forward. The pawn can move one square forward and, unlike chess, it captures the same way. There are no pieces corresponding to the queen in chess or the lance in Shogi.

The objective of the game is to checkmate the opponent's king, and the rules relating to check and checkmate are similar to chess.

When a player's pawn first reaches the promotion line 20A or 20B furthest from that player, the player may promote that piece by exchanging it for one of the knights waiting in reserve. The promotion of pawns can only occur twice in the game as there are only 2 knights in the set. As, at the commencement of play, the knights are not owned by either player, it is possible for the one player to gain both knights.

Unlike the black and white pieces in a chess set, the pieces per se have no visual indication of ownership, and ownership of the pieces is indicated by the orientation of the pieces on the board. In particular, each piece has a base 10 with direction indicating means pointing in the direction of play, that is, away from the owner of the piece. Alternatively, or in addition, the upright stem 12 of each piece may have a marking, such as a coloured sticker 22, on its front. This latter feature assists easy identification of the direction and therefore the ownership when the board is congested, as the bases of the pieces may be partly obscured from view.

Captured pieces are removed from the board and retained by the captor for return to the board later as the captor's own. In any turn, a player may 'drop' a previously captured piece onto a vacant square, the direction indicator of the dropped piece facing towards the opponent. With the exception of pawns, there are no restrictions on the dropping of pieces, and it is possible to check or checkmate the opponent's king by dropping a piece. A captured bishop can be dropped onto any vacant black or white square, although the bishops start the game only on black squares. However, a pawn cannot be dropped onto a square directly in front of the opponent's king, nor onto a file already occupied by a pawn belonging to the same player.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A set of pieces for a modified version of chess for two players in which ownership of the pieces may change throughout the course of the game, comprising two subsets of pieces for ownership initially by respective players, wherein each piece has an upright stem portion having a shape which indicates the denomination of the piece, each piece also having direction indicating means for indicating the orientation of the piece relative to a player and hence the ownership of the piece throughout the course of the game, wherein each subset includes at least one king, two gold generals, two silver generals, two bishops, two rooks, and nine pawns.

2. A set of pieces according to claim 1, including a pair of knights which are not owned by either of the players at the start of the game and which may be exchanged for pieces of lower denomination during the course of the game.

3. A board game for two players comprising:

a) a game board having a grid with a plurality of rows and columns, and b) a set of pieces, each piece having an upright stem portion having a shape which indicates the denomination of the piece each piece also having direction indicating means for indicating the orientation of the piece relative to a player, wherein ownership of said pieces by a respective player may change during the course of the game and the orientation of each piece relative to a player indicates ownership of each piece throughout the course of the game, and said set of pieces includes at least two kings having a highest denomination, four high denomination generals, four low denomination generals, four bishops, four rooks, and eighteen pawns, said pieces being divided equally between said players at the start of the game.

4. A board game for two players comprising:

a) a game board having a arid with a plurality of rows and columns;

b) a set of pieces, each piece having an upright stem portion having a shape which indicates the denomination of the piece each piece also having direction indicating means for indicating the orientation of the piece relative to a player; and c) a pair of additional pieces, wherein ownership of said pieces by a respective player may chance during the course of the game and the orientation of each piece relative to a player indicates ownership of each piece throughout the course of the game, two subsets of said set of pieces are arranged on said game board at the start of the game, each subset being owned by a respective player, said pair of additional pieces are kept off the board at the start of the game, during the course of the game each of said pair of additional pieces may be exchanged for one of said set of pieces, each of said subsets includes one king having a highest denomination, two high denomination generals, two low denomination generals, two bishops, two rooks, and nine pawns, and said pair of additional pieces is a pair of knights.

* * * * *